US009926121B2

(12) United States Patent
Lingamfelter

(10) Patent No.: US 9,926,121 B2
(45) Date of Patent: Mar. 27, 2018

(54) CONTAINER FOR PROVIDING EASY ACCESS TO BEVERAGE CANS

(76) Inventor: C. Brown Lingamfelter, Stewart, FL (US)

( * ) Notice: Subject to any disclaimer, the term of this patent is extended or adjusted under 35 U.S.C. 154(b) by 88 days.

(21) Appl. No.: 10/997,712

(22) Filed: Nov. 24, 2004

(65) Prior Publication Data

US 2005/0072705 A1 Apr. 7, 2005
US 2006/0289322 A2 Dec. 28, 2006

Related U.S. Application Data

(63) Continuation of application No. 10/935,209, filed on Sep. 7, 2004, now abandoned, which is a continuation (Continued)

(51) Int. Cl.

| | |
|---|---|
| ***B65D 75/00*** | (2006.01) |
| ***B65D 71/36*** | (2006.01) |
| ***B65D 5/02*** | (2006.01) |
| ***B65D 5/16*** | (2006.01) |
| ***B65D 5/468*** | (2006.01) |

(Continued)

(52) U.S. Cl.

CPC ..... *B65D 71/36* (2013.01); *B65B 11/004* (2013.01); *B65B 61/14* (2013.01); *B65B 61/18* (2013.01); *B65D 5/0227* (2013.01); *B65D 5/16* (2013.01); *B65D 5/4608* (2013.01); *B65D 5/542* (2013.01); *B65D 2571/0045* (2013.01); *B65D 2571/0058* (2013.01); *B65D 2571/0066* (2013.01); *B65D 2571/00141* (2013.01); *B65D 2571/00456* (2013.01); *B65D 2571/00561* (2013.01); *B65D 2571/00574* (2013.01);

(Continued)

(58) Field of Classification Search

CPC ..... B65D 5/0227; B65D 5/16; B65D 5/4608
USPC ..... 206/161, 193, 427, 499; 229/108, 164, 229/117.13, 117, 122.1, 122, 237, 238, 229/240, 242; 221/31, 32, 303, 305
See application file for complete search history.

(56) References Cited

U.S. PATENT DOCUMENTS

| | | |
|---|---|---|
| 1,541,143 A | 6/1925 | Hoile |
| 1,925,102 A | 9/1933 | Levkoff |

(Continued)

FOREIGN PATENT DOCUMENTS

| | | |
|---|---|---|
| CA | 874828 | 7/1971 |
| CA | 2246020 | 2/2000 |

(Continued)

OTHER PUBLICATIONS

Exhibit A—Litigation in the U.S. District Court for the Northern District of Georgia, Atlanta Division, Civil Action No. 1-04-CV-0842(JEC); *Graphic Packaging International, Inc.* v. *C. Brown Lingamfelter*.

(Continued)

*Primary Examiner* — Luan K Bui
(74) *Attorney, Agent, or Firm* — Jackson Walker, LLP

(57) ABSTRACT

A container having a multiplicity of cans therein. The container disclosed is modified from a rectangular, closed wall container to a container with part of the walls removed, thereby allowing easy access to the cans of the container. Applicant discloses a unique relationship between the walls of the opened container and the size of the beverage cans. Applicant also discloses a method for constructing a closed container that may be easily modified to remove the cans of the container.

29 Claims, 3 Drawing Sheets

Related U.S. Application Data of application No. 10/388,951, filed on Mar. 14, 2003, now Pat. No. 6,789,673, which is a continuation of application No. 09/946,004, filed on Sep. 4, 2001, now Pat. No. 6,550,615, and a continuation of application No. 09/542,661, filed on Apr. 4, 2000, now Pat. No. 6,283,293.

(51) Int. Cl.

| | |
|---|---|
| ***B65D 5/54*** | (2006.01) |
| ***B65B 11/00*** | (2006.01) |
| ***B65B 61/14*** | (2006.01) |
| ***B65B 61/18*** | (2006.01) |

(52) U.S. Cl.

CPC ..... *B65D 2571/00728* (2013.01); *B65D 2571/00895* (2013.01); *B65D 2571/00901* (2013.01)

(56) References Cited

U.S. PATENT DOCUMENTS

| | | | | |
|---|---|---|---|---|
| 2,718,301 | A | | 9/1955 | Palmer |
| 2,723,027 | A | | 11/1955 | Guyer |
| 2,842,304 | A | * | 7/1958 | Ringler ..... 229/117.13 |
| 2,930,516 | A | | 3/1960 | Fowle et al. |
| 2,975,891 | A | | 3/1961 | Stone |
| 3,002,651 | A | | 10/1961 | Gauld |
| 3,178,242 | A | | 4/1965 | Ellis et al. |
| 3,228,582 | A | | 1/1966 | Osberg |
| 3,263,861 | A | | 8/1966 | Carr |
| 3,265,283 | A | | 8/1966 | Farquhar |
| RE26,083 | E | | 9/1966 | Forrer |
| 3,300,115 | A | | 1/1967 | Schauer |
| 3,356,279 | A | | 12/1967 | Root |
| 3,517,858 | A | | 6/1970 | Farquhar |
| 3,540,581 | A | | 11/1970 | Koolnis |
| 3,669,251 | A | | 6/1972 | Phillips, Jr. |
| 3,712,533 | A | | 1/1973 | Skillen |
| 3,765,327 | A | | 10/1973 | Aronson et al. |
| 3,765,527 | A | | 10/1973 | Vargo |
| 3,894,681 | A | | 7/1975 | Arneson et al. |
| 3,913,739 | A | | 10/1975 | Hennessey |
| 4,000,811 | A | | 1/1977 | Hardison et al. |
| 4,030,596 | A | | 6/1977 | Snyder et al. |
| 4,155,449 | A | | 5/1979 | Bryne |
| 4,214,660 | A | | 7/1980 | Hunt, Jr. |
| 4,222,485 | A | | 9/1980 | Focke |
| 4,364,509 | A | | 12/1982 | Holley, Jr. et al. |
| 4,375,258 | A | | 3/1983 | Crayne et al. |
| 4,396,143 | A | | 8/1983 | Killy |
| 4,416,410 | A | | 11/1983 | Herrmann |
| 4,417,661 | A | | 11/1983 | Roccaforte |
| 4,498,581 | A | | 2/1985 | Dutcher |
| 4,582,199 | A | | 4/1986 | Schuster |
| 4,726,471 | A | | 2/1988 | Whately et al. |
| 4,785,991 | A | * | 11/1988 | Schuster ..... 229/117.13 |
| 4,919,266 | A | | 4/1990 | McIntosh et al. |
| 4,966,324 | A | | 10/1990 | Steel |
| 4,974,771 | A | | 12/1990 | Lavery |
| 5,123,589 | A | | 6/1992 | Cote |
| 5,137,211 | A | | 8/1992 | Summer et al. |
| 5,170,934 | A | | 12/1992 | Lemoine |
| 5,279,440 | A | | 1/1994 | Fougeres et al. |
| 5,368,194 | A | | 11/1994 | Oliff et al. |
| 5,465,831 | A | | 11/1995 | Smith |
| 5,622,309 | A | | 4/1997 | Matsuda et al. |
| 5,722,584 | A | | 3/1998 | Fujiwara |
| 5,775,574 | A | | 7/1998 | Whitnell |
| 5,788,117 | A | | 8/1998 | Zimmanck |
| 5,878,947 | A | | 3/1999 | Hoy et al. |
| 6,105,854 | A | | 8/2000 | Spivey et al. |
| 6,176,419 | B1 | | 1/2001 | Holley, Jr. |
| 6,283,293 | B1 | | 9/2001 | Lingamfelter |
| 6,789,673 | B2 | | 9/2004 | Lingamfelter |

FOREIGN PATENT DOCUMENTS

| | | |
|---|---|---|
| DE | 7510538 | 8/1975 |
| DE | 8514718 | 8/1985 |
| DE | 3612594 A1 | 10/1987 |
| EP | 0849189 A1 | 6/1998 |
| GB | 2186550 | 8/1987 |
| JP | 7-9721 | 2/1995 |
| JP | 11-171264 | 6/1999 |
| WO | WO 96/29260 | 9/1996 |
| WO | WO 97/21607 | 6/1997 |

OTHER PUBLICATIONS

Exhibit B—Brief in Opposition to Defendant's Motion to Dismiss Plaintiffs Complaint.

Exhibit C—Litigation in the U.S. District Court for the District of Delaware, Civil Action No. 04-1261; *C. Brown Lingamfelter* v. *Coca-Cola Enterprises, Inc. et al*.

Exhibit D—Graphic Packaging International, Inc. Request for Reexaminatino.

Exhibit E—MeadWestvaco Packing Systems, LLC Request for Reexamination.

US Patent and Trademark Office, Trademark Trial and Appeal Board, in re Merged Inter Partes Reexaminations: 95/000,066 (Reexam I) and 95/000,069 (Reexain II), Office Action in Inter Partes Reexamination, Attached as Exhibit F.

US Patent and Trademark Office, Trademark Trial and Appeal Board, in re Merged Inter Partes Reexaminations: 95/000,066 (Reexam I) and 95/000,069 (Reexam II), Response to Office Action, Attached as Exhibit G.

US Patent and Trademark Office, Trademark Trial and Appeal Board, in re Merged Inter Partes Reexaminations: 95/000,066 (Reexam I) and 95/000,069 (Reexam II), Comments of Third Party Requester MeadWestvaco, Attached as Exhibit H.

US Patent and Trademark Office, Trademark Trial and Appeal Board, in re Merged Inter Partes Reexaminations: 95/000,066 (Reexam I) and 95/000,069 (Reexam II), Comments of Requester, Graphic Packaging International, Inc., Attached as Exhibit I.

USPTO, Board of Patent Appeals and Interferences, *Meadwestvaco Packaging Systems, et al* v. Patent of *C. Brown Lingamfelter*, Appeal 2009-002578, Reexamination Control Nos. 95/000,066 and 95/000,069, Decided: Mar. 15, 2011.

Patent Owner's Request to Reopen Prosecution (Feb. 11, 2010); Requester Comments on Request to Reopen Prosecution (Requester II) (Mar. 11, 2010).

Requester Comments on Request to Reopen Prosecution (Requester I) (Mar. 11, 2010); Examiner's Determination after Board Decision (Jun. 18, 2010).

Comments on Examiner's Determination after Board Decision (Patent Owner) (Jul. 16, 2010); Comments on Examiner's Determination after Board Decision (Requester II) (Jul. 19, 2010).

Reply to Patent Owner's Comments (Requester II) (Aug. 16, 2010); Reply to Patent Owner's Comments (Requester I) (Aug. 16, 2010).

Reply to Requester's Comments (Patent Owner) (Aug. 19, 2010); Appeal Docketing Notice (Oct. 1, 2010).

USPTO, Board of Patent Appeals and Interferences, *Meadwestvaco Packaging Systems, et al* v. Patent of *C. Brown Lingamfelter*, Appeal 2009-002578, Reexamination Controls 95/000,066 and 95/000,069, Decided: Jan. 12, 2010.

US Court of Appeals for the Federal Circuit, *C. Brown Lingamfelter* v. *David J. Kappos, Direcctor, US Patent and Trademark Office, Meadwestvaco Packaging Systems, LLC and Graphic Packaging International, Inc.*, 2011-1449, Judgment/Opinion.

* cited by examiner

CONTAINER FOR PROVIDING EASY ACCESS TO BEVERAGE CANS

This is a continuation of and claims priority from U.S. patent application Ser. No. 10/935,209, filed Sep. 7, 2004, which is a continuation of and claims priority from U.S. patent application Ser. No. 10/388,951, filed Mar. 14, 2003 (now U.S. Pat. No. 6,789,673, issued Sep. 14, 2004); which is a continuation of and claims priority from U.S. patent application Ser. No. 09/946,004, filed Sep. 4, 2001 (U.S. Pat. No. 6,550,651); which is a continuation of and claims priority from U.S. patent application Ser. No. 09/542,661, filed Apr. 4, 2000 (U.S. Pat. No. 6,283,293).

FIELD OF THE INVENTION

Beverage can containers, more specifically a beverage can container for providing easy access to the beverage cans contained therein.

BACKGROUND INFORMATION

Beverages, such as soda or beer, often come in cylindrical, aluminum, typically 12 oz. cans. Traditionally, one could buy a single can or a "six pack." The six pack is simply six cans contained in a typically rectangular paper container or hung on interconnected plastic rings.

More recently, cans of soda and beer have become available in packs of twelve cans. The twelve pack is typically rectangular cardboard with the cans, usually in a 4×3 matrix arrangement, stacked closely next to one another. The twelve pack has walls typically constructed of light cardboard or thick paperboard, being thicker than writing stock paper but not as robust or thick as corrugated cardboard. These twelve packs presently enjoy popularity with use by Coca-Cola and Pepsi-Cola, the two leading providers of soda as well as by many major domestic beer companies.

The twelve pack containers provide a convenient means to carry the beverage cans but are not handy for dispensing the cans. Typically, the consumer will purchase the twelve pack, bring it home, tear the pack open and pull out the cans to stack them in the refrigerator, discarding the container. Applicant provides, however, for a modification to the currently available twelve pack to convert the carrying container to a dispensing container. That is, the cans will remain within the carrying container, the container acting, as modified by applicant as a beverage can dispenser.

An object of Applicant's present invention is to provide for a container for beverage cans which will allow easy access to the beverage cans for easy removal but will also hold the beverage cans therein.

It is also an object of Applicant's present invention to provide a modification to currently existing beverage can containers so that the containers, as modified, will provide easy access to the cans therein.

This and other objects are provided for in a generally rectangular, paper beverage can container with a corner removed on a diagonal line across the two side walls, the line running from a front wall to the adjacent top wall.

There are a number of benefits with Applicant's novel beverage container with a dispensing cutout therein. These include ease of access. This is obtained by placing the twelve pack container on edge with a cutout in the upper corner. Easy and fast accessibility to the cold beverage cans will increase consumption and sales of the product.

Applicant's invention also provides for gravity feed to enhance access to the beverage cans. This is created by the weight of the cans when the beverage container is placed in a vertical position. This position naturally pushes the cans, under the influence of gravity, towards the front wall of the container. The cutout location is designed to take maximum advantage of this gravity feed.

Another advantage of Applicant's invention is the ability to effectively utilize space, especially in a refrigerator or kitchen cabinet. By placement of the cutout in the position indicated, the container may be placed vertically to save space.

DETAILED DESCRIPTION OF THE PREFERRED EMBODIMENT

Line 12A shows the position of a line on the front wall of a beverage container from one side wall to the next, the line being straight and meeting the edge between the front wall and the side wall at a 90° angle. The line 12D shows the position of a diagonal line across each of the two side walls between the front wall and the top wall, lines 12D, at 12B and 12C showing a preferred range of the position of line 12D with respect to the top wall. Line 12E is a line across the top wall, one side wall to the next and perpendicular to the edges of the top wall. The beverage container will be cut through along lines 12A, 12D and 12E to remove section 12 from the rest of the container (See FIG. 1B). The position of lines 12A, 12D and 12E may be premarked, scored (or otherwise weaken) by the manufacturer of the beverage container so as to direct the consumer to the position for cutting and removing portion 12.

Figure 1:
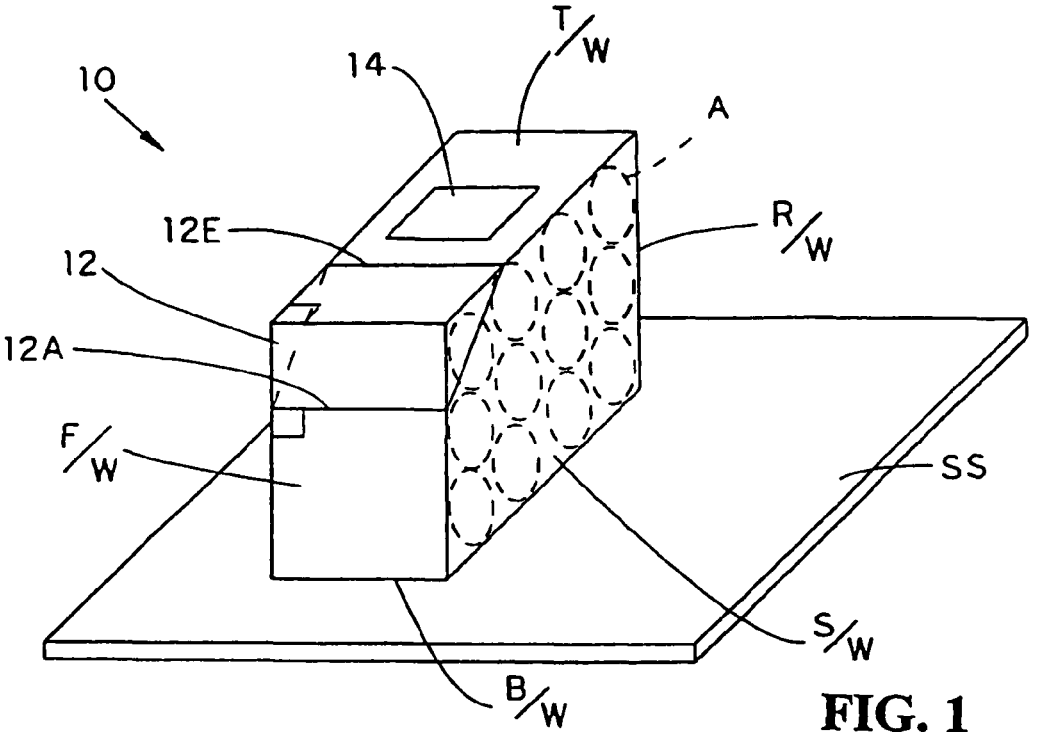
FIG. 1 is a perspective view of the preferred embodiment of applicants invention.
Figure 1B:
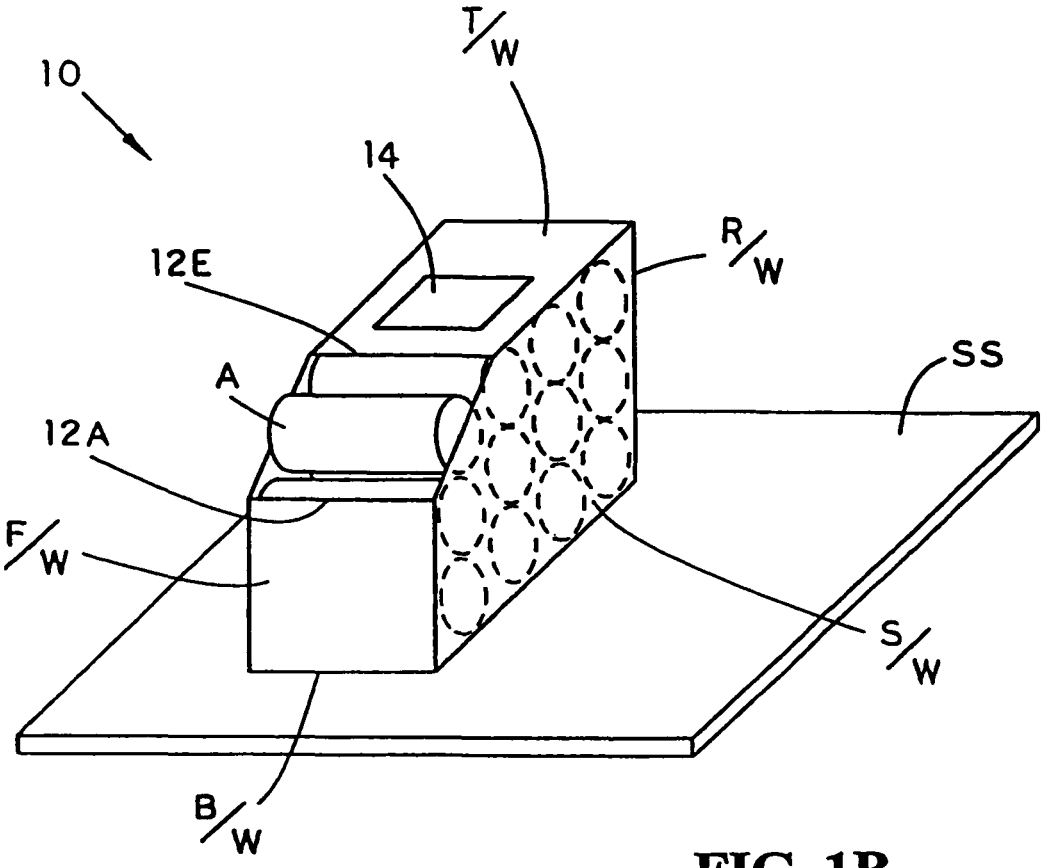
FIG. 1B is a perspective view of the beverage container modified accordingly to Applicant's invention.

FIG. 1 is a perspective view of a modified twelve pack container 10 with cylindrical aluminum 12 oz. beverage cans A packed inside in a 4×3 arrangement and designating two side walls S/W, a top wall T/W, a bottom wall B/W, a front wall F/W and a rear wall R/W. It is noted that the two side walls have the greatest surface area, the top and bottom walls having a surface area between the two side walls and the front and rear walls, which have the least surface area. A support surface, such as a refrigerator shelf, is designated SS. The top, bottom, front and rear walls are defined when the container is placed on a support surface, as illustrated in FIG. 1, with the F/W chosen to provide for the most convenient access. FIG. 1 also illustrates Applicant's modification, being a cut or removed portion 12, the removed portion being a corner of the container where the front wall meets the top wall and defined by a diagonal line across the two sidewalls between the front wall and the top wall, and a line across the top wall and across the front wall, this line along which the removed portion is defined designated 12A.

Figure 2:
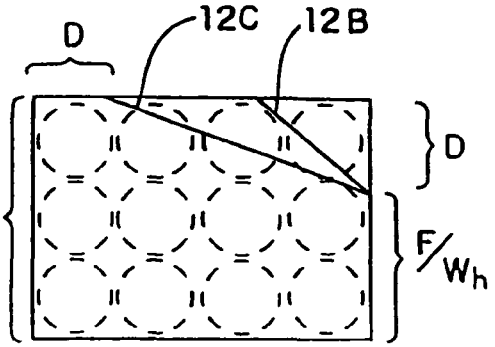
FIG. 2 is a side elevational view of the preferred embodiment of applicants invention.
Figure 1A:
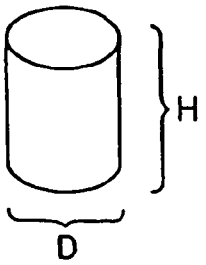
FIG. 1A is side view of a 12 oz. beverage can.

FIG. 2 illustrates a side elevational view of the twelve pack of FIG. 1 wherein the dimension designated D is the approximate diameter of a 12 oz. aluminum beverage can, typically about 6.6 centimeters. As can be seen in FIGS. 1 and 2 the typical twelve pack beverage container is a little over 4 diameters long (about 26 cms) and about 3 "diameters" high (about 20 cms) to enclose therein, in a 3×4 matrix, twelve cans. Furthermore it sometimes includes a handle 14 thereon, the handle typically being walls defining a cut out in the top wall for the receipt of a hand thereinto. The height (H) of a typical 12 oz. metal beverage can is about 12.6 cm.

In FIG. 2 it is seen that Applicant modifies the standard heavy paper wall twelve pack container by cutting off the corner created by the joinder of the front wall and top wall. This is preferably done in the manner illustrated in FIGS. 1 and 2. The preferred height of the front wall defined after the cut across the front wall is less than two diameters but greater than one diameter, more preferably between 1.50 and 1.80 times D. Indeed, the most preferred height of the front wall defining the cut to remove portion 12 is between 11/4 diameter and 1¾ diameter. Such dimension allows easy receipt of the second course of cans but is high enough to prevent the second course of cans from falling out when there are still 3 courses in the container.

The preferred length of the top wall defined after the cut is between 1 and 3 diameters, preferably between 1 and 2 diameters. These cut dimensions are illustrated by lines 12B and 12C set forth in FIG. 2.

Cuts along the lines 12A, 12D and 12E may be made with a knife, razor or any other suitable instrument. When the cuts are made as set forth in FIGS. 1 and 2, portion 12 can be removed (See FIG. 1B) and the single can at the top corner will then be removed and the container placed in the position illustrated in FIG. 1 for easy dispensing of the remaining cans.

Figure 3:
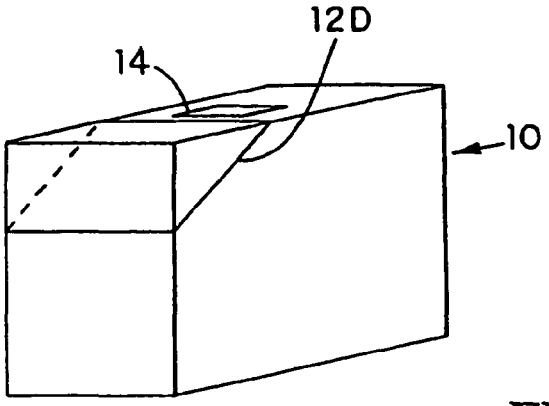
FIG. 3 is a side elevational view of an embodiment of Applicants invention.

FIG. 3 provides for a diagonal cut 12C across the side walls S/W's that terminates adjacent handle 14. Handle 14, in a 4×3 twelve pack is usually at 2 diameters from a top edge (half way across top wall T/W) to provide for proper balance.

Figure 4:
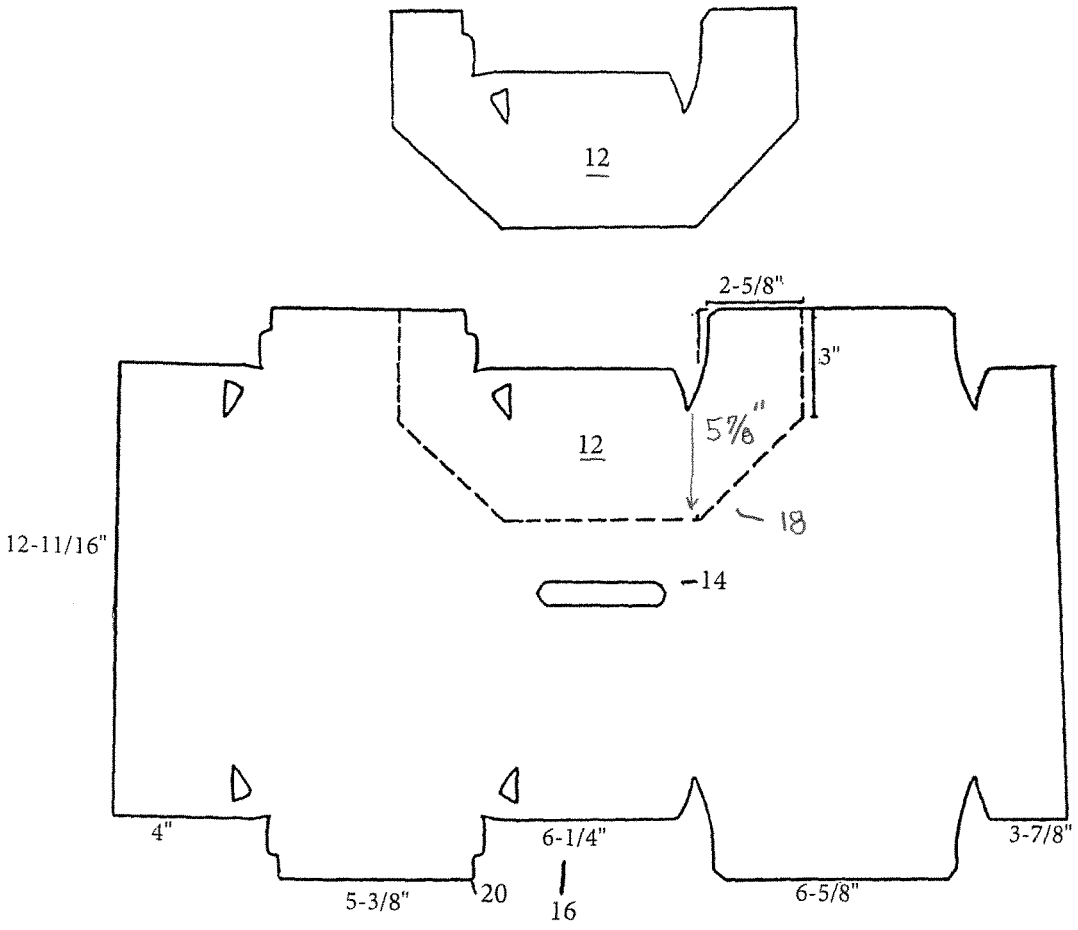
FIG. 4 is a two dimensional pattern of a typical paper twelve pack container illustrating the area removed to provide for applicants unique dispenser.

FIG. 4 illustrates a flattened twelve pack pattern 16 which will fold together to provide for a typical twelve pack with dimension. Handle 14 is illustrated. Scored line 18 is made as part of the process of constructing the container, typically after the outer perimeter 20 defining the pattern 16 of the box is formed. Scored line 18 may be grooves, scratches or notches, or any other means known in the trade to weaken the paperboard such that it is easier for the user to remove portion twelve. Indeed, with proper scoring in ways known in the trade, it is fairly easy to remove portion twelve without a cutting instrument. Note in FIG. 4 that folding the pattern 16 will provide for the twelve pack illustrated in FIGS. 1-3 with the diagonal line 12D running across the side walls from the front wall F/W to the top wall T/W.

In an alternate preferred embodiment Applicant provides a twelve pack container with a line marked on the front wall F/W at between 1D and 2D, on the top wall T/W between 1D and 3D and across the two side walls S/W's to define the pattern for removal of a corner 12 of a twelve pack container as illustrated in FIGS. 1-4 to show a consumer that they may cut the container along the line to convert it into the Applicants novel dispenser container as illustrated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A container comprising:

a plurality of walls including a front wall, a rear wall, a top wall, a bottom wall and two side walls, the walls containing a multiplicity of stacked cylindrical cans in substantially perpendicular can columns and can rows, the can columns located between the front wall and the rear wall, there being at least a top can row and a next to the top can row, the top can row including a forward most can adjacent the front wall such that the forward most can is in contact with the front wall, and a rearward most can adjacent the rear wall such that the rearward most can is in contact with the rear wall, each can having a can top, a can bottom, a can height, a can diameter, and a longitudinal axis substantially parallel to the front wall, wherein the top wall and the bottom wall are spaced apart by a whole multiple of the can diameters, and the two side walls are spaced apart by the can height, the front wall and rear wall spaced apart by a whole multiple of the can diameters; and a removable access portion, the removable access portion comprised of a portion of each of the top wall, the front wall and the two side walls, such that removal of the removable access portion leaves a pair of side wall edges, which side wall edges expose a substantial part of the can top and the can bottom of the forward most can, for ease of removal of the forward most can, and removal of the removable access portion further provides access to the cans remaining after removal of the forward most can, the top wall portion of the removable access portion having a length of one can diameter;

wherein the front wall retains cans in the next to the top can row from rolling out of the container when the bottom wall is resting flat on a support surface.

2. The container of claim 1, wherein the walls are configured such that a portion of each of an end wall of the forwardmost can is exposed when the removable access portion is removed.

3. A container for holding a multiplicity of cylindrical cans, the container comprising:

an even number of the cylindrical cans, each can comprising a can diameter and a can height, each can further comprising a longitudinal axis;

a rear wall having a rear wall height of a whole multiple of the can diameter;

a front wall spaced apart from the rear wall by a whole multiple of the can diameters, having a front wall height, the front wall height being less than the rear wall height, the front wall being substantially parallel to the longitudinal axes;

a bottom wall having a bottom wall length of a whole multiple of the can diameter;

a top wall having a top wall length less than the bottom wall length by one can diameter; and two side walls, each of the side walls having a front edge running from the front wall to the top wall, the side walls separated by the can height.

4. The container of claim 3 wherein at least part of each edge of the two side walls is oblique with respect to the front wall and the top wall, and wherein the longitudinal axes are substantially perpendicular to the side walls.

5. The container of claim 3, wherein the front wall height is less than the rear wall height by more than one can diameter.

6. A container holding a multiplicity of substantially identical items arranged in a plurality of substantially perpendicular rows and columns, each item having an item diameter and an item height, wherein the arrangement has a top row and a next-to-the-top row, and wherein each column has a column width of the item diameter and each row has a row height of the item diameter, comprising:

a rear wall having a rear wall height of a whole multiple of the row height;

a bottom wall for resting on a support surface having a bottom wall length of a whole multiple of the column width;

a front wall having a front wall height less than the rear wall height but sufficiently high to restrain the next-to-the-top row of items when the bottom wall is resting on the support surface;

a top wall having a top wall length less than the bottom wall length by one item diameter;

two side walls, each of the side walls having a front edge connecting the front wall to the top wall, wherein at least part of each edge is oblique with respect to the front wall and the top wall, the side walls separated by the item height; and wherein each of the items comprises a longitudinal axis substantially parallel to the front wall.

7. A container holding a multiplicity of cylindrical cans, each can having a can diameter and a can height, the container comprising:

a rear wall and a front wall each having a height of a whole multiple of the can diameter;

a bottom wall and a top wall each having a length of a whole multiple of the can diameter;

two side walls between the bottom and top walls, the side walls separated by the can height; and a scored line having a front wall segment running on the front wall, a top wall segment running on the top wall and spaced apart from the front wall, and side wall segments running on the side walls, the scored line defining a removable section of the container, and wherein at least a part of the front wall segment runs at a height less than the rear wall height, at least part of the top wall segment is spaced apart from the front wall by one can diameter, and at least a part of each of the side wall segments runs obliquely with respect to the front wall and the top wall;

wherein each of the cans comprises a longitudinal axis, and wherein the front wall is substantially parallel to the longitudinal axis.

8. A method of providing easy access to items arranged in a container in a plurality of substantially perpendicular rows and columns, each item having an item diameter and an item height, wherein the arrangement has a top row and a next-to-the-top row, and wherein each column has a column width of the item diameter and each row has a row height of the item diameter, comprising:

providing a rectangular paper container comprising six rectangular walls including two side walls separated by the item height, a front wall and a rear wall separated by a whole multiple of the column width, and a top wall and a bottom wall adapted to rest on a support surface, the bottom wall and top wall separated by a whole multiple of the row height, the rear wall having a rear wall height;

scoring a front wall score on the front wall, at least a part of the front wall score being made at a height less than the rear wall height but sufficiently high to restrain the next-to-the-top row of items when the bottom wall is resting on the support surface and when the front wall is separated at the front wall score;

scoring a top wall score on the top wall such that the top wall score is spaced apart from the front wall by one item diameter; and scoring side wall scores on the side walls, at least a part of each of the side wall scores being made oblique to the front wall and the top wall;

wherein the scores define a section, the removal of which allows easy access to the items, and wherein each of the items comprises a longitudinal axis substantially parallel to the front wall.

9. A container comprising:

an even number of substantially identical cylindrical items contained within the container, each item having a height and a diameter; and a rectangular carton, adapted to contain the items in a row and column arrangement of substantially perpendicular rows and columns, the row and column arrangement including a top row and a next-to-the-top row, the rectangular carton including a front wall, a rear wall, a top wall, a bottom wall for resting on a level support surface, and two side walls, the front and rear walls having a height, the top and bottom walls having a length, the rectangular carton further adapted to enclose the items such that the height of the front wall and the height of the rear wall is equal to a multiplicity of whole item diameters of the items and the length of the bottom wall and the length of the top wall is equal to a multiplicity of whole item diameters of the items and wherein the front wall includes a front wall scored line segment located such that removal of a front wall portion along the front wall scored line segment will define a lip that will retain the next-to-the-top row of cylindrical items from falling out of the container when the bottom wall is on a level support surface, and wherein the top wall includes a top wall scored line segment spaced apart from the front wall by one item diameter such that removal of a top wall portion along the top wall scored line segment results in, in conjunction with the removal of the front wall portion along the front wall scored line segment, an opening providing access to the items and, wherein each of the side walls include a scored line segment at least partly oblique, running between the front wall and the top wall.

10. A method of manufacturing a container:

providing a paper sheet member;

scoring a portion of the sheet member with a score line;

folding the sheet member around a plurality of items, each of the items having an item height, an item diameter, and a longitudinal axis, the folded sheet member defining a generally rectangular container having a top wall, a bottom wall, a front wall, a rear wall, and two side walls containing the items arranged in a plurality of substantially perpendicular rows and columns, the plurality of rows containing at least a top row and a next-to-the-top row, wherein a row height is equal to the item diameter and wherein the front wall and the rear wall are separated by a whole multiplicity of the item diameter and the top wall and the bottom wall are separated by a whole multiplicity of the row height, and the side walls are separated by the item height, and wherein folding the sheet member further comprises:

locating at least a portion of the score line on the front wall so as to define an edge that is sufficiently high to restrain the next-to-the-top row;

orienting the front wall substantially parallel to the longitudinal axes; and locating at least a portion of the score line on the top wall such that the score line on the top wall is spaced apart from the front wall by one item diameter and locating at least a portion of the score line on the side walls.

11. A container comprising:

a plurality of items, each item comprising an item diameter and an item height, each item further comprising a longitudinal axis, and wherein the items are arranged to include a bottom row;

a rear wall having a rear wall height of a whole multiple of the item diameters;

a front wall having a front wall height, the front wall height being less than the rear wall height but capable of restraining at least the bottom row of items from rolling out of the container, the front wall being substantially parallel to the longitudinal axes;

a bottom wall having a bottom wall length of a whole multiple of the item diameters;

a top wall having a top wall length less than the bottom wall length by one item diameter; and two side walls, each of the side walls having a front edge running from the front wall to the top wall, wherein at least part of each edge is oblique with respect to the front wall and the top wall, the side walls separated by the item height.

12. A container holding a multiplicity of substantially identical cans arranged in a plurality of substantially perpendicular rows and columns, each can having a can diameter and a can height, wherein the arrangement has a top row and a next-to-the-top row, and wherein each column has a column width of the can diameter and each row has a row height of the can diameter, comprising:

a rear wall having a rear wall height of a whole multiple of the row height;

a bottom wall for resting on a support surface having a bottom wall length of a whole multiple of the column width;

a front wall having a front wall height less than the rear wall height but sufficiently high to restrain the next-to-the-top row of cans when the bottom wall is resting on the support surface;

a top wall having a top wall length less than the bottom wall length by one can diameter; and two side walls, each of the side walls having a front edge connecting the front wall to the top wall, wherein at least part of each edge is oblique with respect to the front wall and the top wall, the side walls separated by the can height;

wherein each of the cans comprises a longitudinal axis substantially parallel to the front wall.

13. A container holding a multiplicity of cylindrical cans, each can having a can diameter and a can height, the container comprising:

a rear wall and a front wall each having a height of a whole multiple of the can diameter;

a bottom wall and a top wall each having a length of a whole multiple of the can diameter, the top wall including a handle;

two side walls between the bottom and top walls, the side walls separated by the can height; and a scored line having a front wall segment running on the front wall, a top wall segment running on the top wall and spaced apart from the front wall by one can diameter, and side wall segments running on the side walls, the scored line defining a removable section of the container, and wherein at least a part of the front wall segment runs at a height less than the rear wall height, and at least a part of each of the side wall segments runs obliquely with respect to the front wall and the top wall;

wherein each of the cans comprises a longitudinal axis, and wherein the front wall is substantially parallel to the longitudinal axis.

14. A method of providing easy access to items arranged in a container in a plurality of substantially perpendicular rows and columns, each item having an item diameter and an item height, wherein the arrangement has a top row and a next-to-the-top row, and wherein each column has a column width of the item diameter and each row has a row height of the item diameter, comprising:

providing a rectangular paper container comprising six rectangular walls including two side walls separated by the item height, a front wall and a rear wall separated by a whole multiple of the column width, and a top wall having a handle and a bottom wall adapted to rest on a support surface, the bottom wall and the top wall separated by a whole multiple of the row height, the rear wall having a rear wall height;

scoring a front wall score on the front wall, at least a part of the front wall score being made at a height less than the rear wall height but sufficiently high to restrain the next-to-the-top row of items when the bottom wall is resting on the support surface and when the front wall is separated at the front wall score;

scoring a top wall score on the top wall such that the top wall score is spaced apart from the front wall by one item diameter; and scoring side wall scores on the side walls, at least a part of each of the side wall scores being made oblique to the front wall and the top wall;

wherein the scores define a section, the removal of which allows easy access to the items, and wherein each of the items comprises a longitudinal axis substantially parallel to the front wall.

15. A container comprising:

a multiplicity of substantially identical items held in the container in a plurality of rows, each item having an item diameter, an item height, and a longitudinal axis, wherein each row has a row height of the item diameter;

a rear wall and a front wall each being substantially parallel to the longitudinal axes of the items, the rear wall and front wall separated by a whole multiple of the item diameter, the rear wall having a rear wall height;

a bottom wall and a top wall separated by a whole multiple of the row height;

two side walls between the bottom and top walls, the side walls separated by the item height;

the rear, front, bottom, top, and side walls forming a substantially rectangular carton holding the items in an arrangement wherein each row includes a forward most item in contact with the front wall and a rearward most item in contact with the rear wall; and a scored line having a front wall segment running on the front wall, a top wall segment running on the top wall and spaced apart from the front wall by one item diameter, and side wall segments running on the side walls, the scored line defining a removable section of the container, and wherein at least a part of the front wall segment runs at a height less than the rear wall height.

16. The container of claim 15, wherein each of the items comprises a full beverage can, and wherein the longitudinal axes are substantially perpendicular to the side walls.

17. The container of claim 15, wherein the multiplicity of substantially identical items is an even number of substantially identical items, and wherein the longitudinal axes are substantially perpendicular to the side walls.

18. The container of claim 17, wherein each of the items comprises a full beverage can, and wherein the longitudinal axes are substantially perpendicular to the side walls.

19. The container of claim 15, wherein the front wall height is less than the rear wall height by more than one item diameter.

20. A container comprising:

a multiplicity of substantially identical items held in the container in a plurality of rows, each item having an item diameter, an item height, and a longitudinal axis, wherein each row has a row height of the item diameter;

a rear wall and a front wall each being substantially parallel to the longitudinal axes of the items, the rear wall and front wall separated by a whole multiple of the item diameter, the rear wall having a rear wall height;

a bottom wall and a top wall separated by a whole multiple of the row height;

two side walls between the bottom and top walls, the side walls separated by the item height;

the rear, front, bottom, top, and side walls forming a substantially rectangular carton holding the items in an arrangement wherein the plurality of rows comprises a top row and a next-to-the-top row, and each item in the top row is centered on a corresponding item in the next-to-the-top row to form a plurality of pairs of items wherein, for each pair of items, the longitudinal axes of the items in the pair of items are both in a plane that is substantially parallel to the front and rear walls and to a corresponding plane for each of the other pairs of items; and a scored line having a front wall segment running on the front wall, a top wall segment running on the top wall and spaced apart from the front wall, and side wall segments running on the side walls, the scored line defining a removable section of the container, and wherein at least a part of the front wall segment runs at a height less than the rear wall height and at least part of the top wall segment is spaced apart from the front wall by one item diameter.

21. The container of claim 20, wherein each of the items comprises a full beverage can, and wherein the longitudinal axes are substantially perpendicular to the side walls.

22. The container of claim 20, wherein the multiplicity of substantially identical items is an even number of substantially identical items, and wherein the longitudinal axes are substantially perpendicular to the side walls.

23. The container of claim 22, wherein each of the items comprises a full beverage can, and wherein the longitudinal axes are substantially perpendicular to the side walls.

24. The container of claim 20, wherein the front wall height is less than the rear wall height by more than one item diameter.

25. A container comprising:

a multiplicity of substantially identical items held in the container in a plurality of rows, each item having an item diameter, an item height, and a longitudinal axis, wherein each row has a row height of the item diameter;

a rear wall and a front wall each being substantially parallel to the longitudinal axes of the items, the rear wall and front wall separated by a whole multiple of the item diameter, the rear wall having a rear wall height;

a bottom wall and a top wall separated by a whole multiple of the row height;

two side walls between the bottom and top walls, the side walls separated by the item height;

the rear, front, bottom, top, and side walls forming a substantially rectangular carton holding the items in an arrangement wherein the items in each row, with reference to the front and rear walls, are not staggered with respect to the items in any other row; and a scored line having a front wall segment running on the front wall, a top wall segment running on the top wall and spaced apart from the front wall, and side wall segments running on the side walls, the scored line defining a removable section of the container, and wherein at least a part of the front wall segment runs at a height less than the rear wall height and at least part of the top wall segment is spaced apart from the front wall by one item diameter.

26. The container of claim 25, wherein each of the items comprises a full beverage can, and wherein the longitudinal axes are substantially perpendicular to the side walls.

27. The container of claim 25, wherein the multiplicity of substantially identical items is an even number of substantially identical items, and wherein the longitudinal axes are substantially perpendicular to the side walls.

28. The container of claim 27, wherein each of the items comprises a full beverage can, and wherein the longitudinal axes are substantially perpendicular to the side walls.

29. In combination with a refrigerator shelf, a container holding a multiplicity of cylindrical cans, each can having a can diameter and a can height, the container comprising:

a vertical rear wall and a front vertical wall each having a height of a whole multiple of the can diameter;

a horizontal bottom wall and a top horizontal wall each having a length of a whole multiple of the can diameter;

two side walls between the bottom and top walls, the side walls separated by the can height; and a scored line having a front wall segment running on the vertical front wall, a top wall segment running on the horizontal top wall and spaced apart from the vertical front wall by one can diameter, and side wall segments running on the side walls, the scored line defining a removable section of the container, and wherein at least a part of the front wall segment runs at a height less than the rear wall height, and at least a part of each of the side wall segments runs obliquely with respect to the front wall and the top wall;

wherein each of the cans comprises a longitudinal axis, and wherein the front wall is substantially parallel to the longitudinal axis.

* * * * *